US006204822B1

(12) United States Patent
Cardiasmenos et al.

(10) Patent No.: US 6,204,822 B1
(45) Date of Patent: Mar. 20, 2001

(54) MULTIBEAM SATELLITE COMMUNICATION ANTENNA

(75) Inventors: Apostle G. Cardiasmenos, Carlisle; Anthony D. Monk, Lexington; Luther E. Rhoades, North Grafton; John Sangiolo, Newton, all of MA (US)

(73) Assignee: L-3 Communications/Essco, Inc., Concord, MA (US)

( * ) Notice: Subject to any disclaimer, the term of this patent is extended or adjusted under 35 U.S.C. 154(b) by 0 days.

(21) Appl. No.: 09/315,864

(22) Filed: May 20, 1999

Related U.S. Application Data

(60) Provisional application No. 60/086,168, filed on May 20, 1998.

(51) Int. Cl.[7] ..... H01Q 3/12

(52) U.S. Cl. ..... 343/761; 343/781 CA; 343/757

(58) Field of Search ..... 343/761, 757, 343/758, 766, 763, 764, 765, 781 P, 781 CA, 782, 839; H01Q 3/12

(56) References Cited

U.S. PATENT DOCUMENTS

| | | | | |
|---|---|---|---|---|
| 3,914,768 | * | 10/1975 | Ohm | 343/779 |
| 4,298,877 | | 11/1981 | Sletten . | |
| 5,140,337 | | 8/1992 | Rappaport . | |
| 5,175,562 | | 12/1992 | Rappaport . | |
| 5,796,370 | | 8/1998 | Courtonne et al. . | |
| 5,825,333 | | 10/1998 | Kudoh et al. . | |
| 5,844,527 | | 12/1998 | Takashima et al. . | |
| 5,847,681 | | 12/1998 | Faherty et al. . | |
| 5,852,423 | | 12/1998 | Hughes . | |
| 5,856,804 | | 1/1999 | Turcotte et al. . | |

FOREIGN PATENT DOCUMENTS

WO 95/06963 3/1995 (WO) .

OTHER PUBLICATIONS

Goldsmith, Paul F., "The Second Aricebo Upgrade, a reflection of how technology has changed," IEEE, Aug./Sep. 1996, pp. 38–43.

* cited by examiner

*Primary Examiner*—Hoanganh Le
(74) *Attorney, Agent, or Firm*—Wolf, Greenfield & Sacks, P.C.

(57) ABSTRACT

A low-cost spherical reflector and a mechanically scanned antenna system utilizing such reflectors. The system employs one or more (substantially similar) primary spherical reflectors (each a truncated spherical surface), each having an associated moveable feed driven by a two-axis positioner mechanism that has few moving parts. The feed structure may preferably comprise a point source waveguide feed in combination with a shaped concave secondary reflector used in a Gregorian-like configuration to correct for spherical phase error. The positioner mechanism moves the waveguide feed and secondary reflector in tandem to shift the position of the far field beam direction in the sky. After phase correction by the secondary reflector, the resultant signal reflected from the primary aperture can simultaneously transmit and receive at two or more independent frequencies. With an assembly of multiple such spherical reflectors, each having a moveable feed driven by its own positioner mechanism, a compact arrangement is achieved. The assembly is mounted on a circular baseplate and preferably is covered by a radome.

18 Claims, 8 Drawing Sheets

MULTIBEAM SATELLITE COMMUNICATION ANTENNA

CROSS-REFERENCE TO RELATED APPLICATION

Priority is hereby claimed under 35 USC 119(e) to U.S. Provisional Application 60/086,168 filed May 20, 1998.

FIELD OF THE INVENTION

This invention relates to the field of antenna systems for communicating between an earth station and a satellite. More particularly, it relates to a reflector for use in an antenna system and to an antenna system using a plurality of such reflectors for broadband satellite communications systems operating in the microwave and millimeter wave frequency bands. The invention further relates to antennas for communicating with low- and mid-earth orbiting satellites, which traverse the sky somewhat rapidly.

BACKGROUND OF THE INVENTION

In past decades, there have come into widespread use communications systems which employ earth-orbiting satellites to relay communications between earth-based stations ("satellite communications systems"). Now under development and in early stages of deployment are satellite communications systems which utilize broadband signaling and operate in the 11–14 GHz (Ku) band, the 20–30 GHz (Ka) band, and higher millimeter wave bands between about 30 and 70 GHz. (Such systems are hereafter referred to as MMW systems or as Ku, Ka or V band systems.) Many of these MMW systems employ low-earth-orbit (LEO) or mid-earth-orbit (MEO) satellites in constellations, to provide bi-directional, high-speed data links from and to customer premises equipment (CPE) located at various places. They may also use one or more geostationary satellites (GEO's) in combination with LEO or MEO satellites in some types and modes of communications. The Spaceway, Expressway, Cyberstar, and Teledesic systems are the most well-known of these new systems; but in fact there are more than twenty MMW satellite systems in various stages of development and implementation.

All of these MMW systems are global in that they facilitate communications with CPE locations at virtually all points on the surface of the earth. End-user applications for these networks include placing CPE at various types of customer locations, including, for example, large and small business locations, telephone company points of presence (POP), multi-tenant office and apartment buildings, public telephone installations, and individual residences. One significant requirement for direct access to the satellite system from these locations is that a CPE antenna must be provided and that antenna must be capable of tracking simultaneously at least two LEO or MEO satellites to maintain a connection between the user and the network. In many cases, the antenna also must be able to track a geostationary satellite, as well. Further, it is important that such CPE antennas be low-cost devices capable of being made in a high-volume production environment.

At the customer location, the CPE antennas for these new MMW systems must acquire and track multiple satellites. In typical operations, a first LEO satellite is tracked across the sky from its acquisition horizon in the South or North, until it nears the opposite horizon. At that time, a second LEO satellite is acquired as it rises from its acquisition horizon. For a short time, both satellites are tracked, until the CPE link is handed off from the first satellite to the second satellite. This process is repeated as the various LEO or MEO satellites traverse the sky at each CPE location. In order to maintain operative communications links with the satellites of these MMW systems, the antennas used at the customer sites must be able to track at substantially any local azimuth angle and at all elevation angles above about fifteen (15) degrees. (Operation at lower elevation angles is not practical due to the increased atmospheric path loss and the presence of trees and buildings or other nearby structures.) This requires an antenna system with a full sky positioner mechanism that has sufficient accuracy to maintain tracking of a satellite such that a narrow, "pencil" transmission beam stays centered on the satellite as it moves across the sky. To assure adequate noise margin in the communications links, the CPE antennas are required to have diameters ranging from about 0.4 meters for "low end" (i.e., least expensive) residential units to "typical" diameters of about 0.75, 1.0 and 1.5 m for business CPE units. At these diameters, the beam widths at Ku, Ka band and V band are fractions of a degree; therefore, the positioner mechanism for the antenna must be capable of pointing the antenna to better than 0.1 degree of the target satellite position, at all points in the sky. This requires relatively precise positioners, and they often must move not only the entire MMW antenna but also its associated transmitter and receiver electronics.

Both electrically scanned and mechanically scanned antennas previously have been built for operation in satellite communication systems at the lower Ku and C band satellite communication (SATCOM) frequencies. In particular, the industry has a long history of providing Very Small Aperture Terminals (VSAT) for use in C and Ku band satellite links from customer premises. Such existing VSAT terminals use fixed mounted antennas that typically point to one specific GEO satellite location and do not need to be scanned or moved during operation. This fixed VSAT antenna approach is much easier to implement than the approach needed for the new MMW systems that must constantly track moving satellites across the sky.

Traditional parabolic reflectors, although easily manufactured in the small sizes needed, cannot be scanned readily with electronic means. Instead, they must be moved physically to point directly towards the orbiting satellite as it moves across the sky. In these MMW systems, this requires that the parabolic antenna be capable of being pointed to nearly all points in the entire hemisphere above some minimum elevation angle with respect to the horizon. Using traditional parabolic reflector antennas as are now used in Ku and C band VSAT antenna systems, in order to have multiple beams (to communicate simultaneously with multiple satellites), a separate reflector antenna is required for each beam, each having its own mechanical positioner mechanism. Multiple antennas must be used to facilitate the simultaneous tracking of two MEO or LEO satellites that are typically at opposite directions in the sky, and in the case where a GEO satellite is also employed, as many as three separate full-motion antennas must be employed simultaneously. Most of these antennas will be enclosed by a radome, both for aesthetic reasons and to avoid the effects of the environment (e.g., wind, ice, snow, insulation, etc.) on the tracking accuracy of the antenna system.

At the installation site for two (or three) relatively large and complex parabolic reflector tracking antennas, these antennas would be required to be spaced by about 5 m from each other so as not to interfere with each other during concurrent operation. Each antenna would be required to employ a relatively expensive and complicated mechanism to move the entire antenna to point towards the location of each tracked satellite as it moves in the sky. This relatively large installation will present an aesthetic and logistical problem at many locations. Since each antenna not only is moving constantly but also is transmitting RF energy, provisions for radomes must be made to avoid wind deflections and to make the installation safe from and for children, pets, etc.—particularly in residential and business sites. It is also not clear that a suitable high-accuracy positioner can be manufactured at a reasonable, low cost.

One might think of electrically scanned antennas as an alternative, but at the large scan angles required (i.e., nearly a full hemisphere coverage) in these new MMW systems, electrically scanned solid state phased arrays become difficult to implement. Moreover, they would have to have hundreds or even thousands of individual elements, making them both difficult to manufacture and quite costly. It is, however, technically feasible that monolithic GaAs semiconductor integrated circuits could provide 20–50-mW per transmit/receive element; and when used in groupings of around one hundred elements in a small array, this could provide 2–5 W of radiated power. However, the cost is an obstacle. The individual transmit/receive elements used in such solid state arrays at 20–30 GHz currently cost on the order of one hundred dollars each in modest production quantities. Therefore, it appears that arrays made from hundreds of such elements are not going to be affordable for the commercial market and residential markets in a near time frame; and possibly never will be affordable for the larger aperture sizes used for business terminals.

To achieve efficient beam scanning over very wide angular ranges, the fixed spherical reflector with a moveable feed has been known to offer a potentially attractive, low-cost alternative to a scanned parabolic reflector. With such a design, the primary reflector, which is the heaviest component of the system, remains fixed; beam scanning is effected by movement of a small and lightweight feed using a compact scanner mechanism. In its simplest form, a scanning spherical reflector consists of a fixed spherical reflector and a small scanning feed which moves along a spherical pseudo-focal surface located midway between the sphere center and spherical reflector surface. However, to achieve high efficiencies requires non-point source feed systems that use lenses or additionally shaped reflectors to correct for the spherical aberration of the main spherical reflector at the location of the point source feed.

Turning to FIG. 1, there is depicted in general the focus and pointing geometry of a spherical antenna as heretofore known. The aperture 12 of a spherically shaped reflector 10 collects radiation from a direction ($\phi$, $\theta$) defined by the azimuth angle $\phi$ and the elevation angle $\theta$ with respect to the zenith direction. The incident radiation field 14 is a plane wave with its transverse electric and transverse magnetic field components in the plane perpendicular to, and its Poynting vector along the direction defined by ($\phi$, $\theta$) in the region of the antenna aperture. Reflector 10 is a hemispherical surface. It collects electromagnetic energy from far field radiation sources, such that each signal arriving at the plane of the hemisphere's aperture 12 is a plane TEM wave that intersects the aperture plane at some angle ($\phi$, $\theta$) relative to the major axis of the sphere.

Still referring to FIG. 1, for each plane TEM wave intersecting the hemisphere there is a corresponding location where the primary reflector 10 will produce a multitude of focal points 16 that extend in a line from the center point 18 of the radius of the sphere along the direction of the Poynting vector of each incident plane TEM wave as it cuts the plane of the spherical reflector. As a result, electromagnetic radiation 14 arriving at the aperture 12 from a far field source at angle ($\phi$, $\theta$) is collected and focused along a focal line running along the direction ($\phi$, $\theta$). The focal line direction passes through the center 20 of the sphere depending upon the direction to the far field radiation source. In many spherical antenna systems, a device called a "line feed" (not shown) is used to collect all the radiation appearing along the focal line region 16 from the far field source. Unfortunately, such line feeds are difficult to construct and do not usually have large instantaneous bandwidths. Furthermore, in the case of the MMW satellite systems where circular polarization is needed simultaneously at two widely spaced frequencies (one for transmitting and the other for receiving), it is doubtful that a practical low-cost line feed can be implemented which meets all the technical objectives.

Therefore, new approaches are needed for implementing cost-effective scanned antennas for MMW systems.

SUMMARY

To address these needs, a compact, low-cost reflector is provided, together with a mechanically scanned antenna system utilizing such reflectors. The system employs one or more (substantially similar) primary spherical reflectors (each a truncated spherical surface), each having an associated moveable feed driven by a positioner mechanism that has few moving parts and therefore is inherently reliable. The feed structure may preferably comprise a point source waveguide feed in combination with a shaped concave secondary reflector used in a Gregorian-like configuration. The positioner mechanism moves the waveguide feed and secondary reflector in tandem to shift the position of the far field beam direction in the sky. After phase correction by the secondary reflector, the resultant signal reflected from the primary aperture can simultaneously transmit and receive at two or more independent frequencies. These may, for example, be the 20 GHZ and 30 GHz frequencies used in Ka band SATCOM systems. Suitable feed radiators can be waveguides (as already noted), planar printed circuit radiators, non-planar printed circuit radiators, or other operable non-resonant structures.

According to one aspect of the invention, there is provided an assembly of three such spherical reflectors, each having a moveable feed driven by its own positioner mechanism. The assembly is mounted on a circular baseplate and preferably is covered by a radome.

According to another aspect of the invention, there is provided, for use in an antenna, a spherical reflector element which may be scanned by a mechanically-positioned feed over a predetermined azimuthal arc between a first azimuthal scan angle limit and a second azimuthal scan angle limit and over a predetermined elevation arc between a first elevation scan angle limit and a second elevation scan angle limit, said element being formed in the shape of a less than hemispherical portion of a spherical shell that is symmetric about a center of the sphere of which the shell is a portion, the extent of the shell providing an inner surface such that at each azimuthal and elevation scan angle limit, a projected aperture of the region of the reflector illuminated at that scan angle limit is not shadowed by the region of the reflector illuminated at the other extreme of azimuthal and elevation scan angle limit and the radius of the spherical shell is such that a predetermined communication link margin is achievable over the entire scan range between said limits.

Still another aspect of the invention is a spherical primary reflector for an antenna comprising a shell having a reflective surface, the shell and the surface being formed into the shape of a portion of a sphere with the reflective surface toward the inside of the sphere, the extent of the portion of the sphere being such that (1) there can be fit therein a semi-infinite set of circular regions of a predetermined plane diameter D that are parallel to a tangent to the spherical inner surface at the center of the circular regions, at all points between the extremes of the spherical surface region, said diameter D corresponding to a desired antenna gain to achieve a desired communications link margin, (2) a corresponding semi-infinite set of lines drawn from the center point of each said circle through the center of the spherical shell comprising the allowable set of pointing vector directions includes all lines which point to any elevation angle between predetermined first and second elevation angle limits and which point to associated azimuthal angles between predetermined first and second azimuthal angle limits, and (3) incident radiation from a plane wave electromagnetic source within the set of allowable pointing vector directions failing onto said reflector surface with a projection onto a circular region of diameter D without being shadowed by any portion of the reflector.

A further aspect of the invention is an antenna comprising a spherical primary reflector formed as a shell having a reflective surface, the shell and the surface being formed into the shape of a portion of a sphere with the reflective surface toward the inside of the sphere, the extent of the portion of the sphere being such that (1) there can be fit therein a semi-infinite set of circular regions of a predetermined plane diameter D that are parallel to a tangent to the spherical inner surface at the center of the circular regions, at all points between the extremes of the spherical surface region, said diameter D corresponding to a desired antenna gain to achieve a desired communications link margin, (2) a corresponding semi-infinite set of lines drawn from the center point of each said circle through the center of the spherical shell comprising the allowable set of pointing vector directions includes all lines which point to any elevation angle between predetermined first and second elevation angle limits and which point to associated azimuthal angles between predetermined first and second azimuthal angle limits, and (3) incident radiation from a plane wave electromagnetic source within the set of allowable pointing vector directions falling onto said reflector surface with a projection onto a circular region of diameter D without being shadowed by any portion of the reflector; and a feed assembly having (1) a spherical-aberration-correcting secondary reflector and (2) a feed element, the secondary reflector and feed element being placed such their principal axes of symmetry are collinear and lie upon a line passing through the center of the sphere and the center of the secondary reflector, and wherein the secondary reflector is positioned and shaped such that all possible ray paths starting from the feed and traveling to the secondary reflector from which they are reflected to the primary reflector become substantially the same path length, such that a point source radiator illuminating the secondary reflector and therefrom the primary reflector shall produce a highly collimated quasi-plane TEM wave radiation along the direction of the Poynting vector. The feed optionally may be a point source dual frequency feed. It may radiate polarized radiation at one or preferably both of said dual frequencies. That polarization may be linear but preferably is circular. The secondary reflector and the feed may direct radiation along any direction included in the set of allowable Poynting vector directions towards said primary reflector surface to illuminate the primary reflector for transmitting radiation or to receive radiation. Such an antenna may further include a positioner mechanism to position the feed assembly to transmit radiation to and receive radiation from a desired direction.

In an exemplary form of such an antenna, the primary reflector is mounted in a fixed position and the positioner mechanism supports and moves the feed assembly about an azimuthal bearing and an elevation bearing to provide azimuthal and elevational rotation of the feed assembly relative to the primary reflector to rotate and position the feed assembly such that radiation from the feed can be Poynting to all directions in the set of allowable Poynting vector directions.

According to another aspect, the aforesaid antenna of claim 10 further includes a support structure for supporting the positioner mechanism; a transmitter waveguide routed along the support structure to the azimuthal bearing; a first rotary waveguide joint attached to the support structure and having an input connected to the transmitter waveguide at the azimuthal bearing and having an axis and an output which rotate in the azimuthal plane; a second rotary waveguide joint having an input and an output rotatable about the input in the elevational plane; a connecting waveguide member having a first end connected to the output of the first rotary joint and a second end connected to the input of the second rotary joint; a first motorized drive connected to and operable to effect rotation of the connecting waveguide member in the azimuthal plane; the feed assembly connected to the output of the second rotary joint; and a second motorized drive connected to and operable to effect rotation of the feed assembly in the elevational direction.

The antenna may further include a control computer operable to control the drive mechanisms to point the feed assembly so as to achieve a Poynting vector for radiation from the feed along any of the allowed Poynting vector directions.

In some embodiments of the antenna, the surface of the primary reflector spans less than a hemisphere, and it may span significantly less than a hemisphere.

Yet another aspect of the invention is an antenna system having at least two such antennas as heretofore defined co-located, providing the capability for at least two simultaneous and independent transmitter or receiver, or transmitter and receiver, beams. The beams together thus may point to substantially all possible directions in a hemisphere above a predetermined minimum elevation angle with respect to local horizon.

In an illustrated embodiment thereof, the antenna system may include three co-located antennas whose beams together can point to all possible directions in the hemisphere above an elevation angle of about 15 degrees with respect to the horizon, with the primary reflectors of the antennas each spanning substantially less than a hemisphere. A compact design results therefrom.

A still further aspect of the invention is an arrangement of interconnection and control circuits for switching between and controlling use of the apertures provided by the primary reflectors of such an antenna system as satellites traverse the sky.

Yet another aspect of the invention is a low-cost, reliable positioner mechanism for use with such antennas, as herein described.

These and other features and advantages of the invention will be better understood when reference is made to the detailed description below, which should be read in conjunction with the accompanying drawing figures.

BRIEF DESCRIPTION OF THE DRAWING

In the drawing, like numerals represent the same or like elements and.

DETAILED DESCRIPTION

Figure 1:
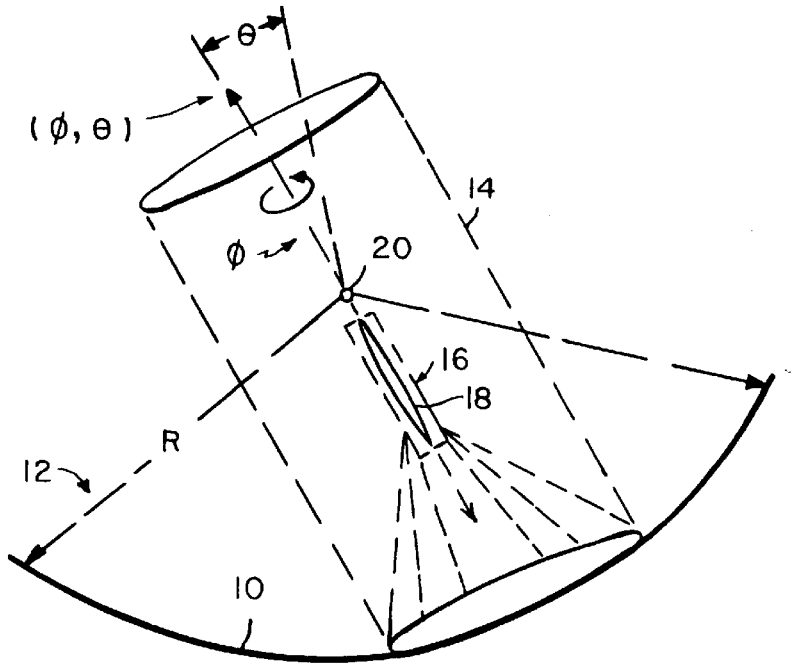
FIG. 1 PRIOR ART
FIG. 1 is a diagrammatic illustration, in cross-section, of a prior art spherical antenna reflector surface and the line focus it produces.
Figure 2:
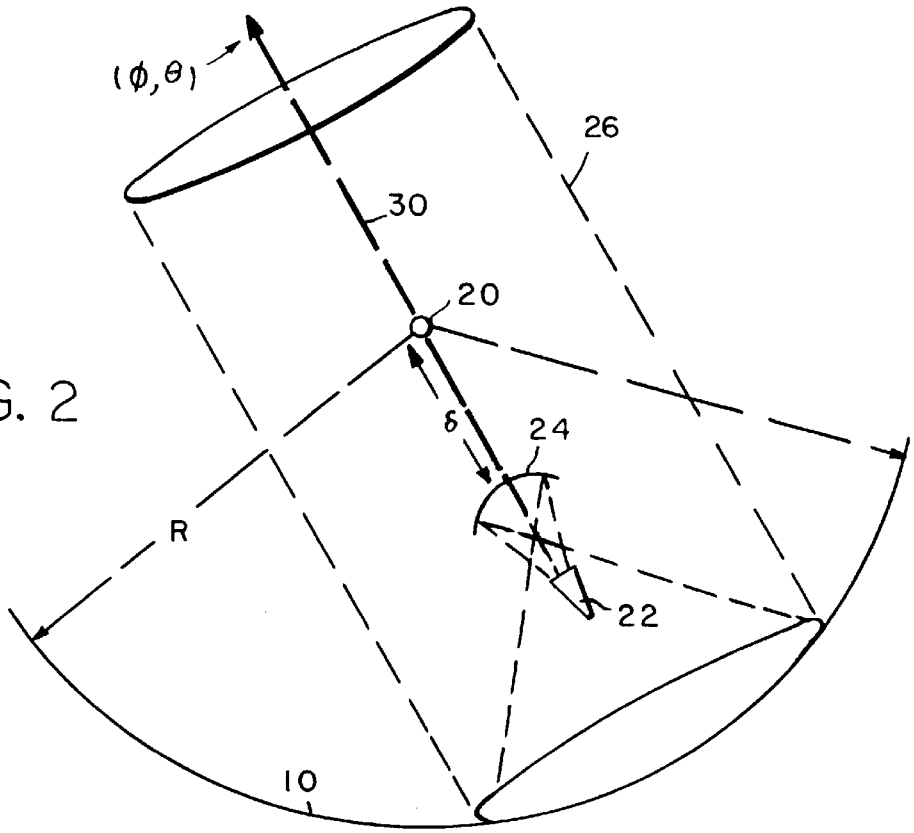
FIG. 2 is a diagrammatic illustration, also in cross-section, of an antenna spherical reflector according to the present invention, and an antenna using said reflector and having a feed assembly according to the present invention, with a point source feed and a Gregorian-like secondary reflector to correct for spherical phase error.

Turning now to FIG. 2, there is shown a diagrammatic illustration of the general focus and pointing geometry of a spherical antenna according to the invention. The line feed illustrated in FIG. 1 is replaced with a set of quasi-optical components that take all the radiation incident in the focal line region and refocus it onto a standard point source feed network. (For purposes of explanation, this discussion assumes the antenna is being used for receiving. It will be appreciated that the "optics" are operable in reverse for transmitting.) Specifically, as shown in FIG. 2, there is provided a standard point source waveguide feed 22 in combination with a shaped concave secondary reflector 24 which is used to provide phase correction to focus the beam. Electromagnetic radiation 26 arriving at the primary aperture 12 from a far field source (not shown) at an angle ($\phi$, $\theta$) illuminates an area 28 and is collected and focused along a focal line 30 running along the axis of symmetry ($\phi$, $\theta$), but by inserting the phase-correcting secondary reflector 24, the radiation is intercepted and refocused onto the point source feed 22 when the secondary reflector 24 is a certain distance, $\delta$, toward the primary reflector from the center 20 of the sphere. The center of the sphere and the shape of the secondary reflector are chosen to maximize the transfer of power from the incident electromagnetic radiation 26 to the point source feed 22, and where the direction of the maximum radiation received by the point source feed is exactly along the direction corresponding to the far field radiation source direction ($\phi$, $\theta$). The theorem of reciprocity then assures that this antenna design will transmit to the far field direction as well as receive from the far field direction for each direction ($\phi$, $\theta$) along which the axis of the secondary correcting mirror and point source feed is positioned within the hemisphere.

The secondary correcting mirror and the point source feed are coupled together mechanically, to maintain the aforesaid relationship. To shift the position of the far field beam, the secondary correcting mirror and the point source feed are moved in unison, rotating their common axis about the center of the sphere. A mechanism for moving the correcting mirror and feed is shown in FIGS. 8–13.

Conventional numerical methods may be employed to design the shape of the correcting mirror. There exist commercially available computer programs which may be employed for this purpose, such as the Mathematica program from Wolfram Research, Inc. of Champaign, Ill. Those skilled in the art of MMW antenna design or optical engineering will understand how to use such a program to create a secondary mirror (reflector) shape that will produce the best focus of incident radiation on the point source feed.

The reduction of the phase error attributable to the spherical shape of the primary reflector can be accomplished in other ways, also, each of which allows spherical reflectors to be used to provide greater electrical aperture sizes. These alternatives include: feed refocusing, matched line feed, matched transverse feed, and a correcting lens.

Figure 3:
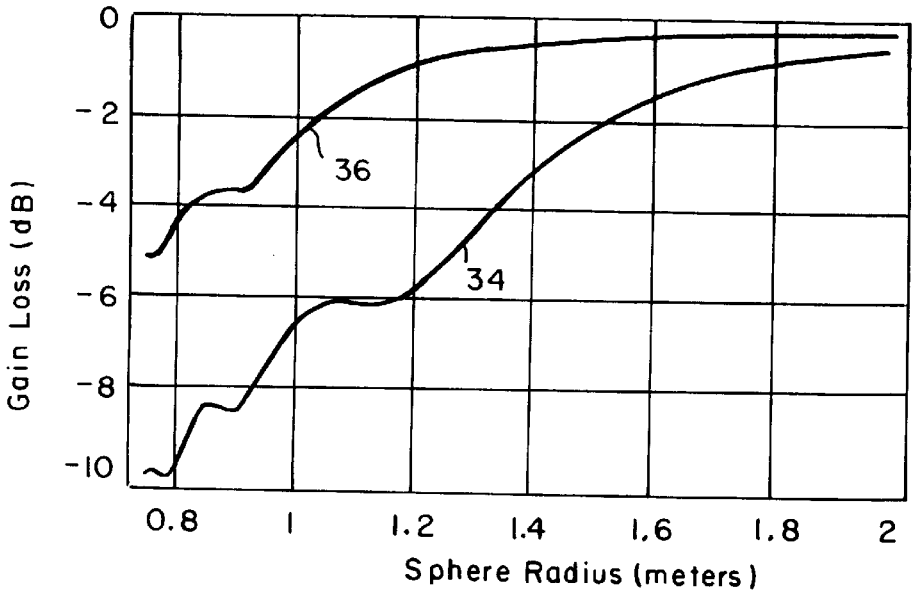
FIG. 3 is a graph illustrating the gain loss of a spherical reflector with the feed located one-half the reflector radius from the reflector surface and with the feed location as optimized to reduce gain loss.

Feed refocusing simply involves movement of the feed scanning surface a small distance toward the reflector surface, to recover some of the gain lost due to the spherical phase error. FIG. 3 illustrates the effect. Curve 34 plots the gain loss with the feed located one-half the reflector radius from the reflector surface. Curve 36 plots the reduced gain loss when the feed location is optimized by using a numerical minimization algorithm to determine the location of the feed which has the lowest loss of gain associated with the spherical phase error. For a spherical reflector of one meter radius, for example, the spherical phase error gain loss at a frequency of 30 GHz is reduced from about 6.6 dB to about 2.4 dB simply by refocusing the feed. This correction scheme supplies only a first-order correction to the spherical phase error, so that the electrical size (in wavelengths) of the primary aperture which can be used efficiently will still be limited. However, the upper limit will be substantially greater than that obtained with the feed located at the half-radius point.

The second and third schemes (matched line feed and matched transverse feed) use modified feed designs which provide a closer match to the non point-focus field distribution, and thereby effectively cancel the spherical phase error. The last scheme (a correcting lens), like the correcting reflector approach, adds a compensating lens to the feed system, to provide a path length correction in order to compensate for, or cancel out, the spherical phase error.

All of these approaches, the illustrated approach and the foregoing alternatives, with the exception of feed refocusing, are capable of providing compensation almost independent of the electrical aperture size, allowing much larger aperture sizes to be realized.

Relatively high gain scanning beams can be produced using a spherical reflector and a spherical phase error correction mechanism as taught herein provided adequate consideration is given to determination of the physical extent of the primary spherical reflector surface needed to allow the beam to be scanned over a specified angular range. This determination is made by mapping the area illuminated by the feed to provide the required aperture onto the reflector surface at the extremes of beam scan. Assuming that the requirement is to provide an overall 360 degrees of azimuthal coverage from the zenith down to an elevation angle of about 15 degrees from the horizontal, then if two beams are provided, each has a coverage of 180 degrees in azimuth. The minimum spherical reflector radius (and, thus, minimum overall system dimensions) is determined geometrically by the need to avoid or minimize "self-shadowing" of the reflector.

Figure 4:
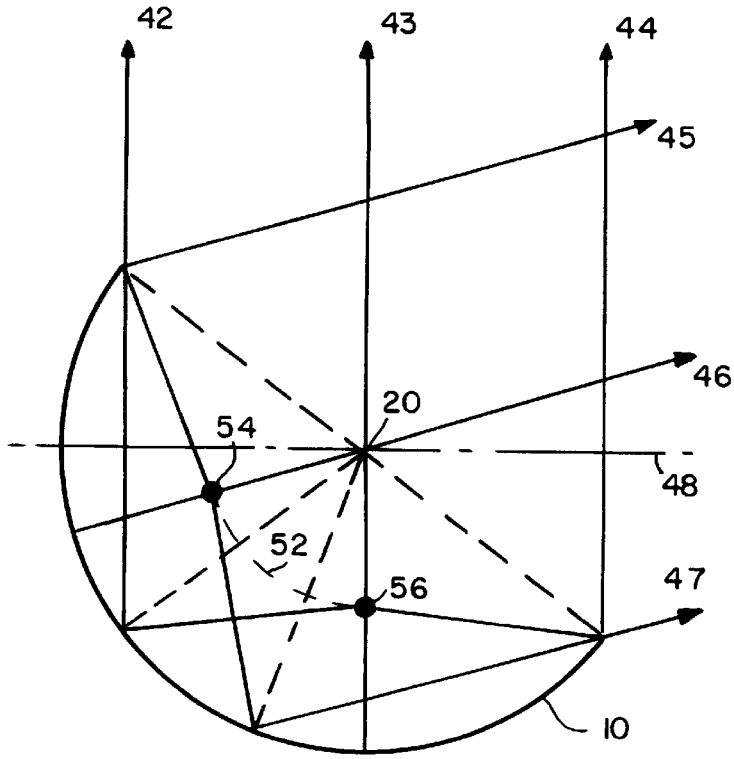
FIG. 4 is a diagrammatic illustration depicting the limiting condition of a spherical reflector comprising a hemisphere and showing the scan range that can be obtained without shadowing.

That is, the reflector is designed so that at one extreme of scan, the projected aperture of the region of the reflector illuminated at that scan angle is not shadowed by the region of the reflector illuminated at the other extreme of scan angle. In the limit of minimum practical sphere radius meeting this criterion, the reflector 10 will comprise a hemisphere, as shown in FIG. 4. FIG. 4 depicts the geometry covering a scan range from the zenith (to which rays 42, 43 and 44 point) down to about 15 degrees elevation (to which rays 45, 46 and 47 point) above the horizon 48. The small circular arc 52 depicts the location of the feed scanning arc, with the feed location at the scan extremes shown as small filled circles 54, 56 at the ends of this arc.

With a two-beam system, whether implemented as a single large symmetric spherical reflector with two separate scanning feeds or as two smaller asymmetric spherical reflectors located "back to back", the self-shadowing design criterion imposes relatively large reflector size when the typical satellite communication system's desired full range of angular coverage is implemented. This is due to the need to avoid "self shadowing" at the extremes of the 180 degree azimuth sectors at very close to the horizon elevation angles. If the coverage requirement could be relaxed, so that coverage is only provided down to a higher elevation angle limit at the extremes of the azimuth range, the reflector dimensions can be reduced substantially. Another variation of this approach, in the form of an exemplary embodiment of the invention, is discussed below.

Figure 5:
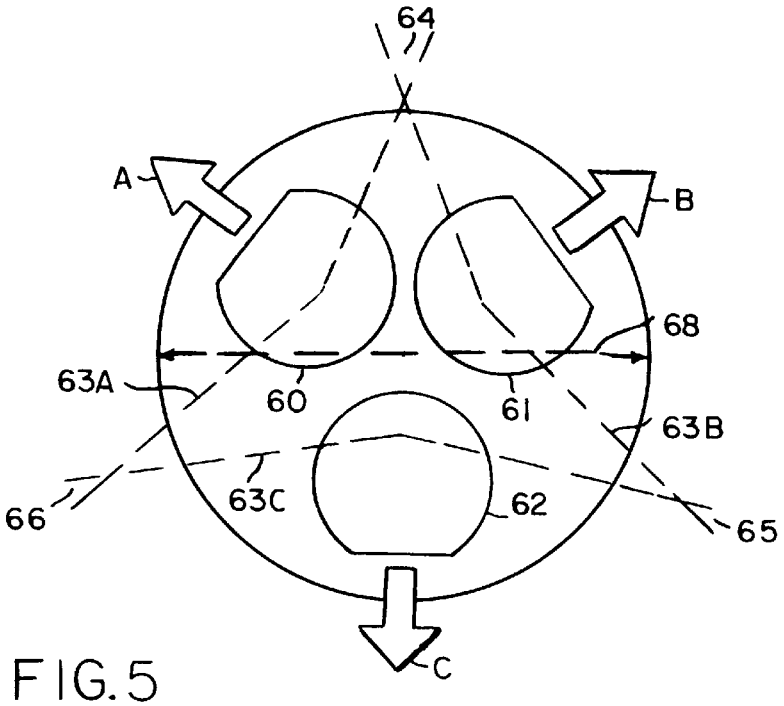
FIG. 5 is a diagrammatic illustration, from a top view, of an embodiment of a three-reflector antenna assembly according to the invention, showing the azimuthal scan coverage provided by each of the three constituent primary reflectors.
Figure 6:
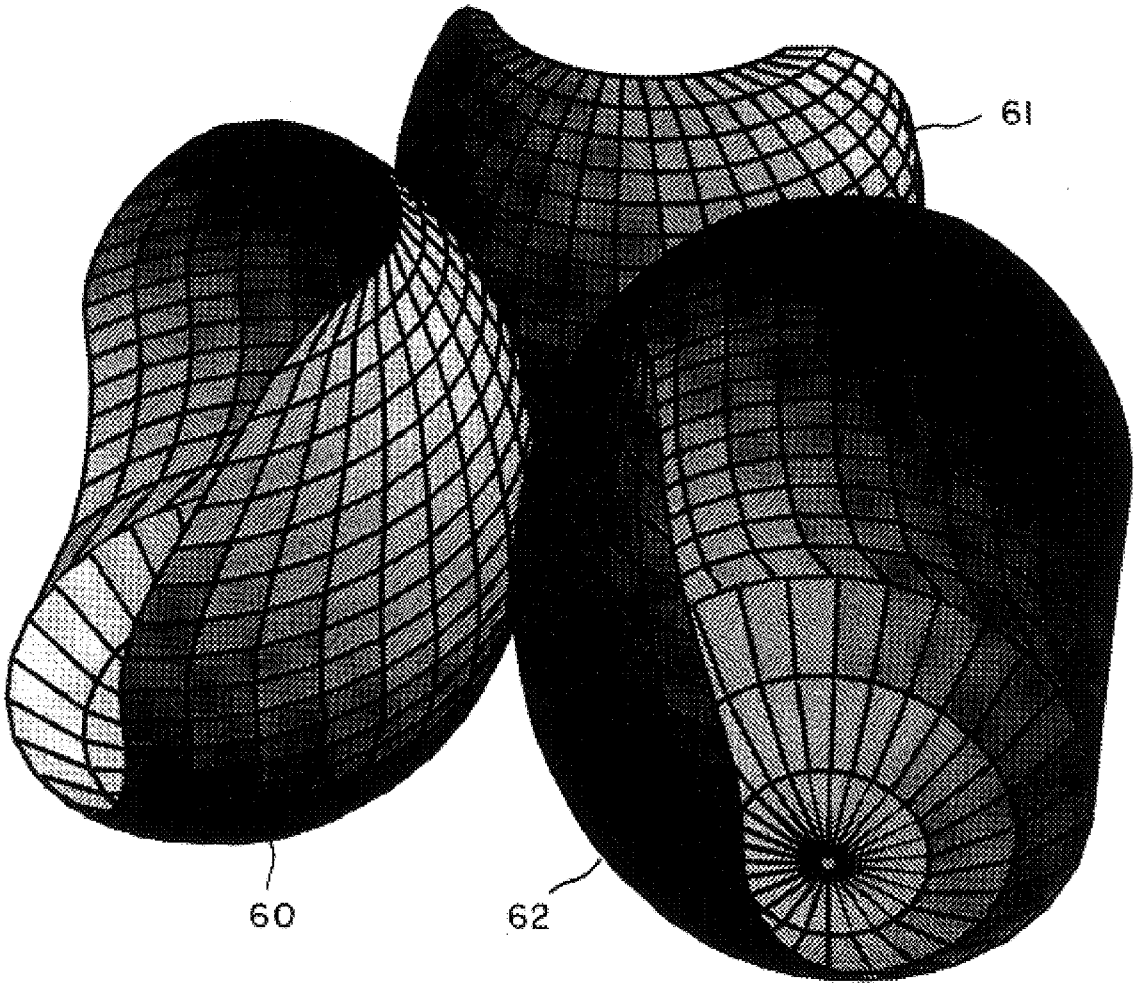
FIG. 6 is a representation of a three-dimensional perspective view of the three primary reflectors of FIG. 5.
Figure 8:
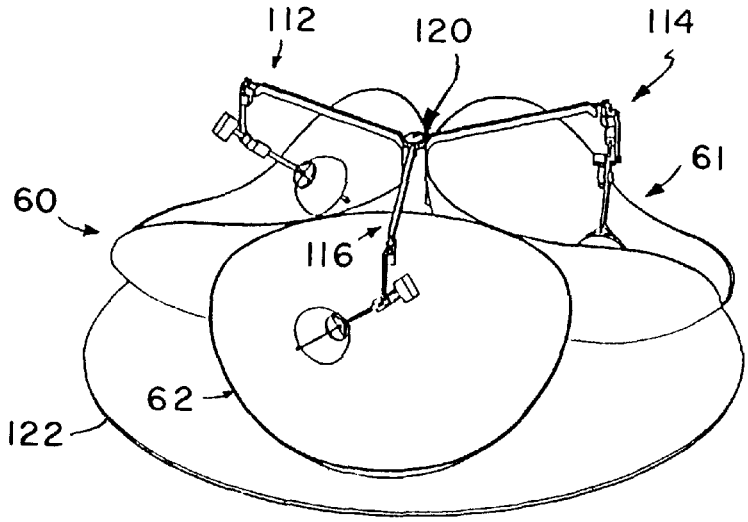
FIG. 8 is an isometric diagram of an exemplary embodiment of a three-antenna assembly such as that illustrated in FIGS. 5 and 6, better illustrating the three assemblies of feeds, secondary reflectors and positioners.

Refer now to FIG. 5. In that drawing figure, there is illustrated diagrammatically a top view of a CPE business-sized multi-beam antenna using spherical reflectors and overcoming the large reflector dimensions imposed by the self-shadowing constraint. The illustrated exemplary system provides three beams represented by bold arrows A, B and C emanating from three separate spherical reflectors 60, 61 and 62 and their feeds (not shown). Each beam covers approximately a 120 degree sector in azimuth, with 15 degree to 90 degree associated elevation coverage; that is, from 15 degrees above the horizon up to the local zenith, which is straight up and perpendicular to the page in the view of FIG. 5. Using the three co-located spherical reflectors results in a dramatic reduction in the overall dimensions of the complete antenna system. Dotted lines 63A, 63B and 63C illustrate the azimuthal boundaries of each coverage for reflectors 60, 61 and 62, respectively. Note the overlap that occurs at the intersections 64, 65 and 66 of the adjacent beams. A three-dimensional view of the main reflectors 60, 61 and 62 is shown in FIG. 6. (Additional views appear in other figures discussed below.) Note that the spherical reflectors are cut away and no longer need be full hemispheres. Each of the primary reflectors is shaped in the form of a part of a spherical shell symmetric about a vertical plane passing through its center. Also, each such reflector is manufactured so as to be highly reflective to electromagnetic radiation incident on its inside surface (e.g., an appropriate metallic surface or a non-metallic surface with a deposited metallic layer). Each spherical shell has been partially truncated (i.e., limited or removed) such that it is less than a hemisphere in extent.

Numerical computation techniques using conventional computer-aided design systems may be employed as follows to design the minimum portion of a spherical surface that will suffice for the antenna. First, a decision must be made regarding the required gain of the antenna. This information is then used to determine the diameter D of a plane circular surface that is needed to provide the antenna gain in the transmit and receive frequency bands to achieve the desired transmit and receive link margins. The minimum extent of spherical surface usable for the reflector is then found, consistent with the angular extent of the region to be scanned by the antenna beam, in terms of both azimuth and elevation. The maximum extent of the spherical surface, consistent with a given radius of curvature, is then that which will accommodate the angular limits without incurring shadowing. More specifically, the surface configuration may be chosen by (1) within the inside surface of the partial sphere of a selected radius, fitting a semi-infinite set of circular regions of a plane diameter D that are parallel to a tangent to the spherical inner surface at the center of the circular regions, at all points between the extremes of the spherical surface region, (2) assuring that the corresponding semi-infinite set of lines drawn from the center point of each said circle through the vertex (center) of the spherical shell (i.e., the allowable set of Poynting vector directions) includes all lines which point to any elevation angle less than a predetermined amount (e.g., about 15 degrees above the horizon) to at least 90 degrees above the horizon and with associated azimuthal angles of at least ±60 degrees relative to the azimuthal symmetry axis of the opening cut into the spherical shell, (3 ) if the allowable set of Poynting vector directions will not include the desired angular ranges and beam scan directions, changing the radius of the spherical shell and repeating the previous steps until a radius has been selected that will produce an allowable set of Poynting vector directions sufficient to include the desired range. Then assuring that the incident radiation from a plane wave electromagnetic source from the set of allowable Poynting vector directions shall fall onto the inside surface of the sphere with projection onto a circular region of said plane diameter without being shadowed by the outer surface of the shell. If shadowing is determined to occur, then the selected radius is changed and a new radius is tested. Finally, the resulting spherical shell will satisfy all requirements to yield an antenna that will scan the desired region of the sky and have the desired sensitivity across the entire region, while having less than a hemispherical extent.

It may be calculated that for a antenna system used in a typical business facility, the overall base diameter 68 of the embodiment of FIGS. 5 and 6 is approximately 2.5 times the effective aperture diameter for each constituent antenna and the height is slightly greater than the effective aperture diameter. If slightly reduced antenna gain can be tolerated near the zenith, additional truncation of the reflectors will allow the base diameter to be reduced further. Based on these ratios, the approximate footprint dimensions (enclosing all three antenna apertures in one constellation) for the three sizes of MMW system CPE antenna terminals used for business applications are as tabulated below in Table I.

TABLE I

| Terminal size | Small | Medium | Large |
|---|---|---|---|
| Effective Aperture Dia. (meters) for each of the three beams | 0.75 | 1.0 | 1.5 |
| Base Footprint Dia. (meters) | 1.875 | 2.5 | 3.75 |
| Radome Height (meters) | 0.8 | 1.2 | 1.7 |

The same feed positioner mechanism may be used for all three sizes of antenna, with only minor changes in the attached waveguide lengths between the positioner and feed aperture. Attached to the feed positioner is the secondary correcting mirror and the point source feed which illuminates it at the transmitter and receiver frequencies.

Figure 7:
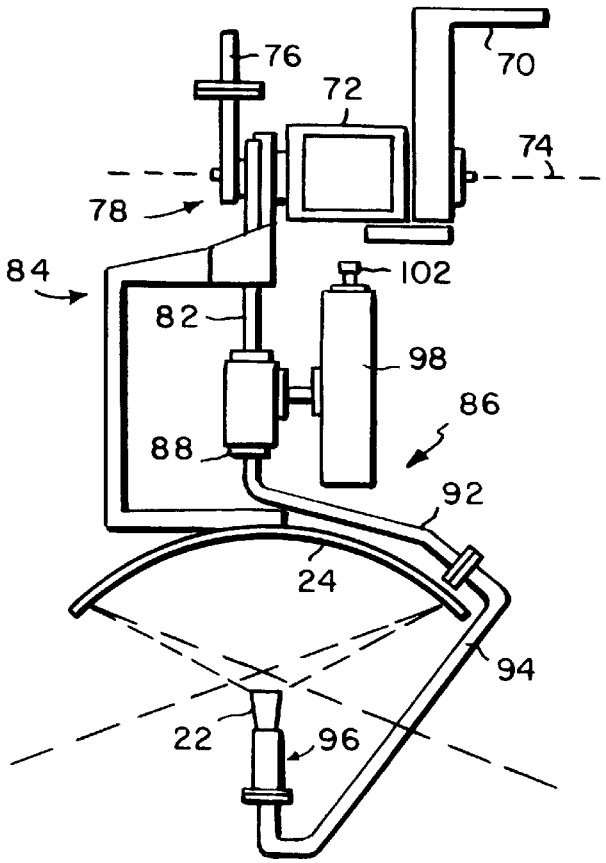
FIG. 7 is a schematic illustration of a representative embodiment of an assembly of a secondary mirror, point source feed and a portion of a positioner according to the invention.

The key features of an exemplary assembly of a secondary mirror, point source feed and positioner are illustrated in FIG. 7, to which attention is now directed. The assembly is supported by (suspended from) a mechanical bracket 70 which is attached to and supported by an azimuthal bearing support structure (not shown). On the bracket 70 a gear head stepping motor 72 is mounted, to provide rotation of the secondary mirror and point source feed about an elevation axis 74. The transmit signal is supplied via a standard rectangular waveguide 76 which is coupled to the input side of a waveguide rotary joint 78. The output side of the rotary joint is connected to a waveguide section 82 and to a mechanical bracket 84. Bracket 84 supports the correcting secondary reflector 24 which is attached to the distal end thereof. Fixed with the bracket 84 is a waveguide assembly 86 (starting with waveguide section 82) which mechanically supports the feed 22. The waveguide assembly includes in series a first waveguide section 82, a diplexer 88, one or more additional waveguide members 92, 94 bent around the edge of the secondary reflector, and preferably a dual frequency waveguide circular polarizer 96. Polarizer 96 converts the linear waveguide polarization to radiated circular polarization at the feed output plane for both the transmit and receive frequencies. In most Ka band MMW systems, the transmitter frequency is near 30 GHz and the receiver frequency is near 20 GHz. The diplexer 88 also connects with a low-noise block downconverter (LNB) 98. The diplexer feeds the received signal from waveguide section 92 to the downconverter 98 which, in turn, produces a frequency-shifted IF output signal (typically at a coaxial connector 102). The waveguide sections 82, 92 and 94 support propagation of both the received and transmitter signals in fundamental mode.

Now referring to FIGS. 8–12, the assembly of the positioners and spherical reflectors for a three-reflector antenna system is shown. The three positioners 112, 114, 116 are supported at the center of the antenna assembly on a post 120 by virtue of which each positioner assembly is supported at the outer perimeter of the associated spherical aperture.

Simple leveling adjustments may be done at the factory to assure that all three positioners point their feeds exactly perpendicular to the circular mounting baseplate 122 when the positioners have been commanded to place the main beams at the local zenith relative to the baseplate.

Figure 9:
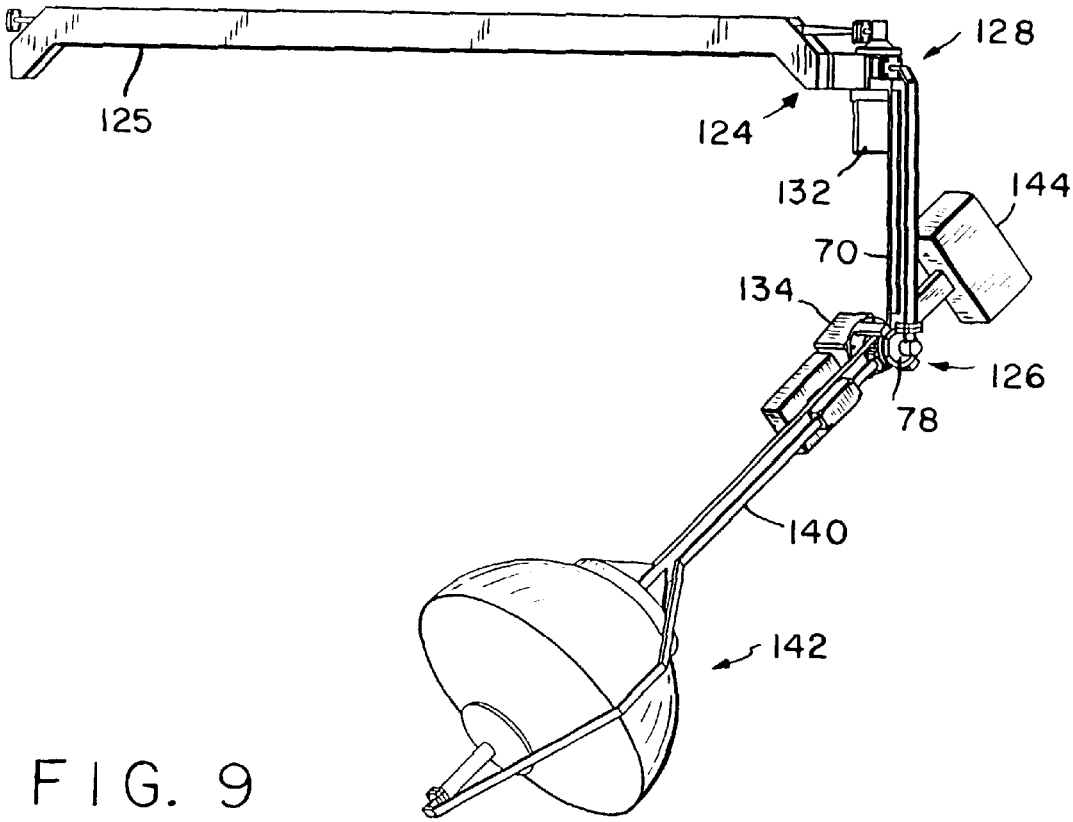
FIG. 9 is a closeup view of a single one of the exemplary feed, secondary reflector, positioner assemblies of FIG. 8.

As more clearly shown in FIG. 9, which illustrates schematically one of the three similar positioners, each positioner consists of an azimuth bearing assembly 124 mounted on the end of a support arm (bracket, etc.) 125 which, in turn, is supported on post 120. All of the positioner components are supported from the end of this arm, including the feed elevation bearing 126. Each of the azimuth bearing assembly and the elevation assembly has a waveguide rotary joint (128 and 78, respectively) passing through its axis so that the transmitter can be located "off dish" (i.e., not on the spherical reflector but, instead, on the baseplate 122; that means neither the feed positioners nor the reflectors need not be constructed to support the weight of the transmitter). Aluminum castings or stampings may be used for most of the major components of the positioner assembly. Each bearing is operated, for example, using a belt drive to a gear head stepper motor (132, 134, respectively) that is controlled by a digital drive circuit (see FIG. 13 and related discussion) preferably located on the baseplate. The elevation motor is mounted 134 is mounted on the feed azimuth bearing assembly 124 via a depending support arm 70 (called the azimuth support arm and previously called a bracket) and produces elevation motion via an idler pulley or direct gear drive, for example, which moves a support arm 140 (called the elevation support arm) and the secondary reflector/feed assembly 142 mounted at the distal end thereof. An elevation counterweight 144 also may be provided, to reduce the torque requirements for the elevation motor. The azimuth motor drive 132 is mounted on the periphery of the spherical reflector and directly drives the feed's azimuth bearing by rotating arm 138. Indexing and positioning may be accomplished by counting the number of steps moved from an indexing bumper during initialization of the scanning system. Alternatively, for larger effective diameter apertures which have a smaller beamwidth in the sky, a direct gear drive from the stepper motor may be implemented and a low-cost encoder may be used to close a positioning loop around each axis of the positioner. It may be necessary or useful to add a low-cost tachometer and velocity feedback loop to smooth the motion of the positioner assembly as it tracks the LEO satellites across the sky.

Figure 10:
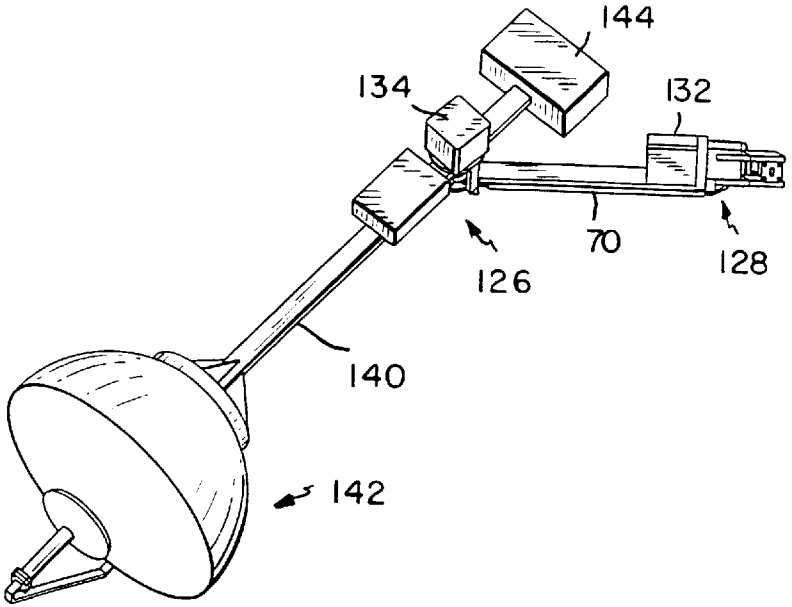
FIG. 10 is another view of the assembly of FIG. 9, taken from the other side.

FIG. 10 shows another view of the positioner/feed assembly of FIG. 9.

Figure 11:
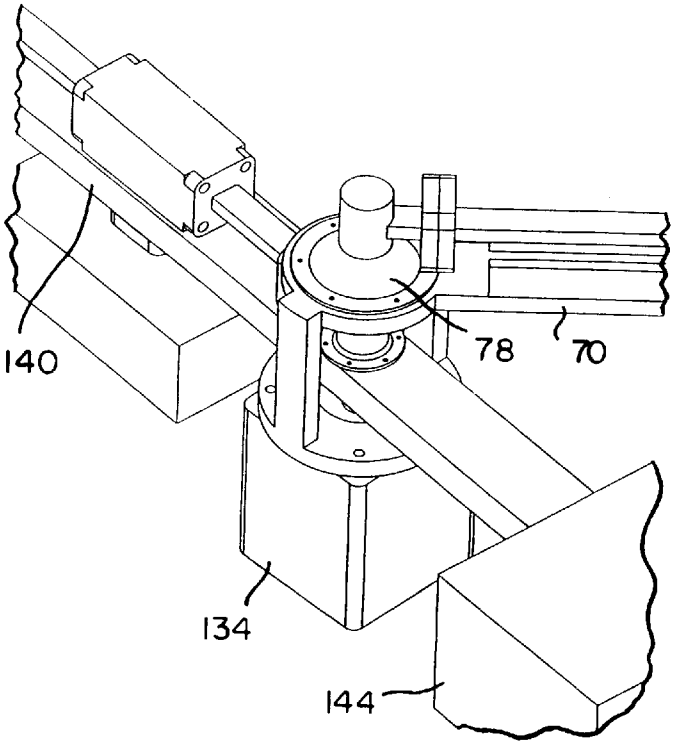
FIG. 11 is a close up view of one of the rotary elevation joints and related apparatus of the exemplary feed, secondary reflector, positioner assemblies.

A closeup view of the elevation rotary joint area is shown in FIG. 11.

Figure 12:
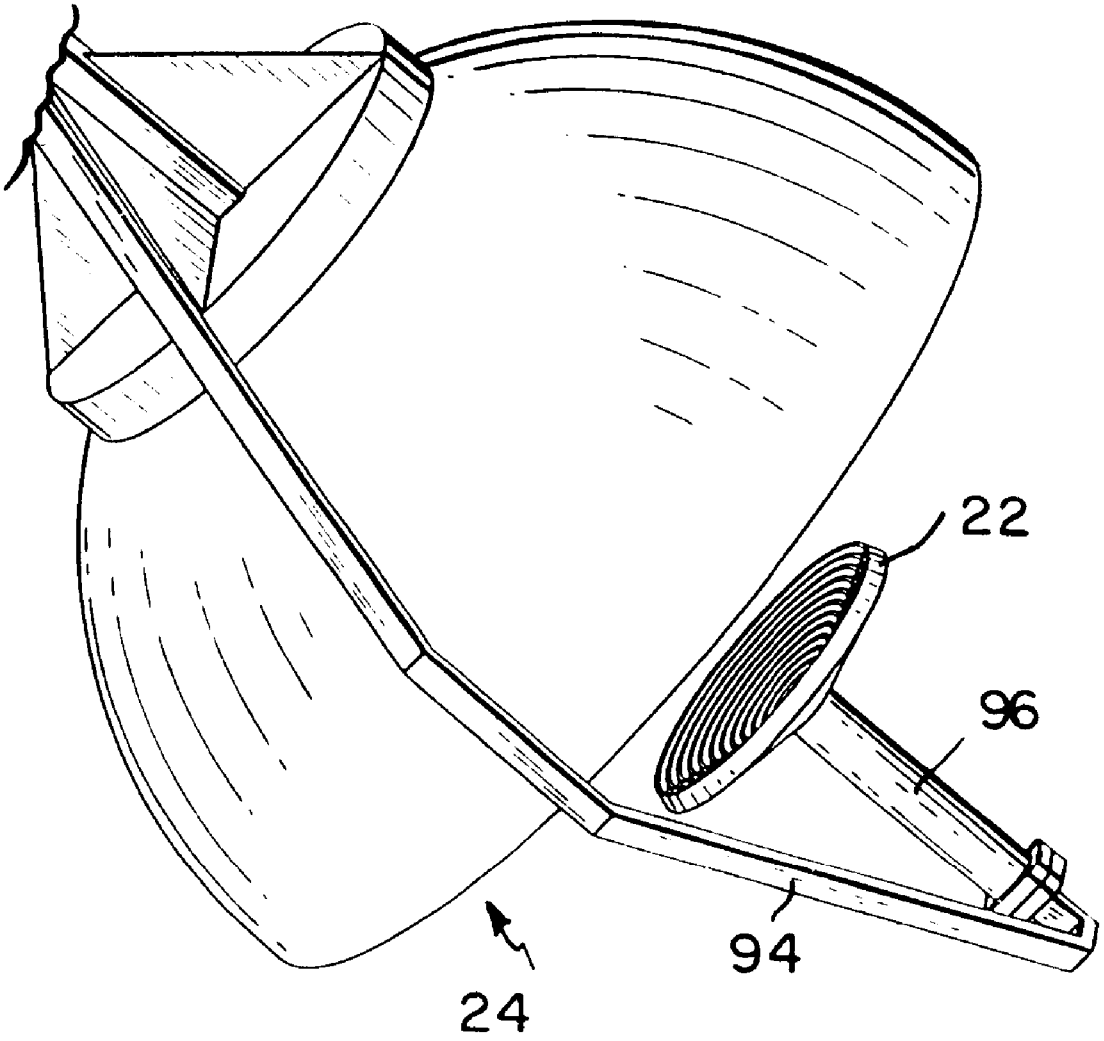
FIG. 12 is a close up isometric view showing the secondary reflector, feed and polarizer of the exemplary assemblies of FIGS. 8–11.

FIG. 12 shows a closeup of the feed and secondary reflector.

The types of stepper motors, stepper motor controller chip sets, and belt or gear drives that may be used in the instant positioner are very similar to those used in mass-market ink jet printers and can be purchased at very low cost. The interconnecting waveguide sections can be fabricated from traditional copper waveguide to keep losses to a minimum for the transmitter path. Together, the central support 120 and the three azimuth support arms 70 may be viewed as an inverted tripod which supports the moveable parts of the positioners and feed. The receiver signal path is through coaxial cable from the block downconverter; the coax cables as well as the wires from and to the stepper motors preferably are routed along the positioner linkage and then down the tripod to the baseplate.

Figure 13:
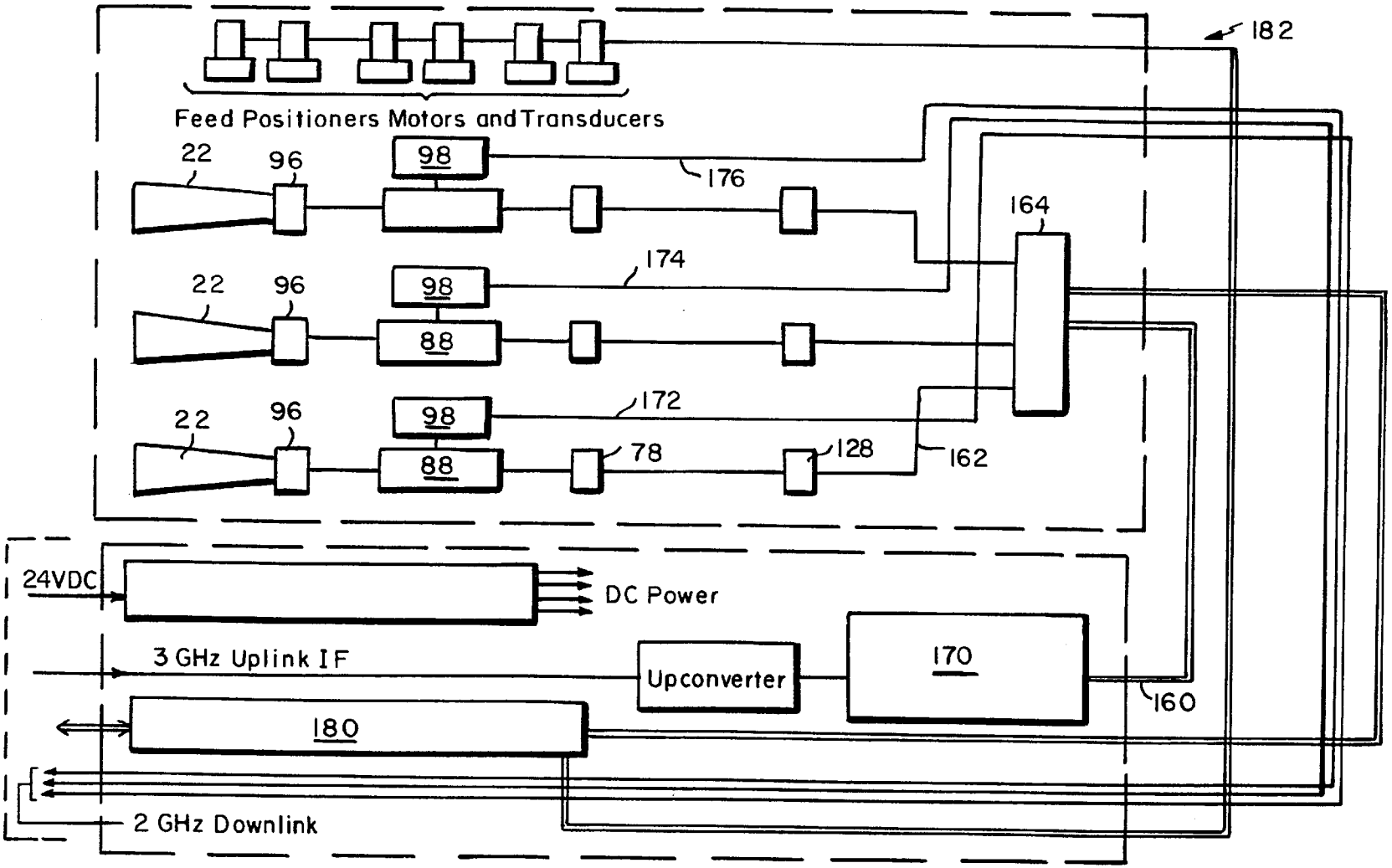
FIG. 13 is a block diagram presentation of the exemplary three-antenna assembly and its electronics.

A block diagram of the resulting antenna system is depicted in FIG. 13. One of the support arms of each aperture's positioner structure is used to route a low loss oversized waveguide 160 in which the high power (e.g., 30 GHz) transmitter signal is guided. The oversized transmitter waveguide 160 is connected to a gradually tapered transition (not shown) to conventionally-sized fundamental mode waveguide shortly before reaching the azimuth axis waveguide rotary bearing. A fundamental mode waveguide 162 then runs via azimuth rotary joint 128 to the elevation rotary joint 78 at the elevation axis. The feed, polarizer and diplexer are then located beyond this point, and the low noise block converter is attached at the receive IF output from the diplexer.

The coaxial IF cable attached to the output of the LNB 98 is routed to the top of the positioner where it is provided with an adequate service loop prior to going down one of the support arms 70 to the edge of the reflector.

A low loss switching matrix 164 preferably would connect the three antenna waveguide inputs to a common transmitter output waveguide 160 (discussed above) from a common output amplifier 170 mounted on the baseplate. Similarly, the coaxial cables 172, 174 and 176 from the three downconverters may be routed to a switch matrix (not shown), and used one at a time or in any combination desired by the MMW system's architecture. Digital circuitry 180 may be mounted on the baseplate, also, to take positioning commands from an external source and use them to control the positioner mechanism (noted generally at 182) as well as to control the transmitter and receiver switching functions. In block diagram form, the motors and their digital control electronics for steering the antenna system are shown in FIG. 13.

The conventional or traditional parabolic reflector antennas described above must be scanned mechanically using large and costly mechanisms. They can only provide single or multiple beams that are pointing in one general direction at a time from any one antenna. By contrast, the present invention can provide multiple simultaneous beams, with each beam pointing in a different direction in the sky and with all beams independently steered. Thus this compact antenna system eliminates the need to have multiple large antennas at each CPE location. Also, it has a very reliable positioner mechanism which uses few moving parts, providing high reliability.

Having thus described the inventive concepts, an exemplary embodiment of the invention and variations thereof, it will be apparent to those skilled in the art of antenna design that various other or alternative embodiments are possible. Thus the disclosed embodiments are presented by way of example only and are not intended as, neither should they be taken to be, limiting. Accordingly, the invention is defined and intended to be limited only by the following claims and equivalents thereof

What is claimed is:

1. An antenna system comprising:

at least a first antenna assembly each antenna assembly having a spherically-contoured primary reflector having a radius of curvature and a reflective surface toward the inside of the sphere; and a feed assembly comprising:

(1) a spherical-aberration-correcting secondary reflector, and (2) a feed element;

wherein the secondary reflector and feed element are placed such that their principal axes of symmetry are co-linear and lie upon a line passing through the center of a sphere corresponding to the spherical contour of the primary reflector, and the center of the secondary reflector; and wherein the secondary reflector is positioned and shaped such that all possible ray paths starting from the feed and traveling to the secondary reflector from which they are reflected to the primary reflector become substantially the same lengths, such that a point source radiator illuminating the secondary reflector and therefrom the primary reflector produces a collimated quasi-plane wave.

2. The antenna system of claim 1, wherein the collimated quasi-plane wave is a TEM wave.

3. The antenna system of claim 1, wherein the feed radiates polarized radiation.

4. The antenna system of claim 1, wherein the feed is a point source dual frequency feed.

5. The antenna system of claim 4, wherein the feed radiates polarized radiation at both of said dual frequencies.

6. The antenna system of any of claims 3 or 5, wherein the polarization is either linear or circular.

7. The antenna system of claim 1, wherein the secondary reflector and the feed direct radiation towards said primary reflector surface parallel to any allowable Poynting vectors to illuminate the primary reflector for transmitting radiation or to receive radiation.

8. The antenna system of claim 1, further comprising a positioner mechanism to position the feed assembly to transmit radiation to and receive radiation from a desired direction.

9. The antenna system of claim 8 wherein the primary reflector is mounted in a fixed position and the positioner mechanism supports and moves the feed assembly about an azimuthal bearing and an elevation bearing to provide azimuthal and elevational rotation of the feed assembly relative to the primary reflector to rotate and position the feed assembly such that radiation from the feed can be pointed to all directions in the set of allowable Poynting vector directions.

10. The antenna system of claim 9 further including a support structure for supporting the positioner mechanism;

a transmitter waveguide routed along the support structure to the azimuthal bearing;

a first rotary waveguide joint attached to the support structure and having an input connected to the transmitter waveguide at the azimuthal bearing and having an axis and an output which rotate in the azimuthal plane;

a second rotary waveguide joint having an input and an output rotatable about the input in the elevational plane;

a connecting waveguide member having a first end connected to the output of the first rotary joint and a second end connected to the input of the second rotary joint;

a first motorized drive connected to and operable to effect rotation of the connecting waveguide member in the azimuthal plane;

the feed assembly connected to the output of the second rotary joint; and a second motorized drive connected to and operable to effect rotation of the feed assembly in the elevational direction.

11. The antenna system of claim 10, further including a control computer operable to control the drive mechanisms to point the feed assembly so as to achieve a Poynting vector for radiation from the feed along any of the allowed Poynting vector directions.

12. The antenna system of claim 1, wherein the surface of the primary reflector spans less than a hemisphere.

13. The antenna system of claim 1 having at least two co-located antenna assemblies, wherein the system provides at least two simultaneous and independent transmitter or receiver, or transmitter and receiver, beams.

14. The antenna system of claim 13 wherein the beams together can point to substantially all possible directions in a hemisphere above a predetermined minimum elevation angle with respect to local horizon.

15. The antenna system of claim 14 including three co-located antennas and wherein the beams provided thereby together can point to all possible directions in the hemisphere above an elevation angle of about 15 degrees with respect to the horizon.

16. The antenna system of any of claims 1–15 further including interconnection and control circuits for switching between and controlling use of the apertures provided by the primary reflectors as satellites traverse the sky.

17. The antenna system of any of claims 1–15 further including a radome covering the antennas.

18. An antenna system comprising:

a plurality of spherically-contoured reflectors, each having a radius of curvature and an aperture of a size and a shape; and exactly one electro-mechanically scannable feed per reflector, each having an azimuthal angle scan range and an elevational angle scan range;

wherein the radius of curvature of the reflectors and the aperture size of the reflectors are individually configured to (1) achieve a desired gain and communications link margin, and (2) cover the entire elevation and azimuthal angle scan ranges of the feeds, such that any Poynting vectors directed between a feed and a corresponding satellite in the sky is not obstructed by any portion of the reflector.

* * * * *